US006776704B2

(12) United States Patent
Goncalves et al.

(10) Patent No.: US 6,776,704 B2
(45) Date of Patent: Aug. 17, 2004

(54) EXTERIOR INLET/EXHAUST PORT

(75) Inventors: Serge Goncalves, Drummondville (CA); Martin Gamelin, St-Francois du Lac (CA)

(73) Assignee: Venmar Ventilation Inc., Drummondville (CA)

( * ) Notice: Subject to any disclaimer, the term of this patent is extended or adjusted under 35 U.S.C. 154(b) by 0 days.

(21) Appl. No.: 10/157,821

(22) Filed: May 31, 2002

(65) Prior Publication Data

US 2002/0197948 A1 Dec. 26, 2002

(30) Foreign Application Priority Data

May 31, 2001 (CA) ..... 2349332

(51) Int. Cl.[7] ..... F23L 17/04
(52) U.S. Cl. ..... 454/8; 126/85 B
(58) Field of Search ..... 454/8; 126/85 B

(56) References Cited

U.S. PATENT DOCUMENTS

| | | | | |
|---|---|---|---|---|
| 171,409 A | * | 12/1875 | Mover | 454/8 |
| 1,968,431 A | | 7/1934 | Wagner | |
| 2,966,838 A | * | 1/1961 | Thompson et al. | 454/8 |
| 2,998,764 A | * | 9/1961 | Bedell et al. | 454/8 |
| 3,225,677 A | | 12/1965 | Steele | |
| 3,245,224 A | | 4/1966 | Wilkinson | |
| 3,426,742 A | * | 2/1969 | Passarello | 126/85 R |
| 3,668,889 A | * | 6/1972 | Magnusson et al. | 62/476 |
| 3,693,610 A | * | 9/1972 | Ehrlichmann | 126/85 B |
| 4,111,004 A | * | 9/1978 | Blomberg | 62/476 |
| 4,940,042 A | | 7/1990 | Moore, Jr. et al. | |
| 5,062,354 A | | 11/1991 | Goins et al. | |
| 5,282,456 A | | 2/1994 | Smelcer et al. | |
| 5,435,377 A | | 7/1995 | Kratochvil | |

FOREIGN PATENT DOCUMENTS

| | | |
|---|---|---|
| DE | 003718796 A1 | 12/1987 |
| JP | 356091122 A | 7/1981 |

* cited by examiner

*Primary Examiner*—Harold Joyce
(74) *Attorney, Agent, or Firm*—Ronald S. Kosie; Robert Brouillette; Gaetan Prince

(57) ABSTRACT

An integrated exterior inlet/exhaust port for providing two air channels through a wall while only requiring a single hole through the wall.

1 Claim, 5 Drawing Sheets

EXTERIOR INLET/EXHAUST PORT

BACKGROUND OF THE INVENTION

The present invention relates to an integrated exterior inlet/exhaust port for use with a ventilation system.

Modern buildings quite often are tightly sealed and insulated to facilitate air handling (i.e. heating and cooling) and to prevent unwanted elements, such as dust and pollution from entering. While the insulation of buildings provides a lot of benefits, it can also unfortunately prevents fresh air from entering an enclosed building and exhausted air from leaving the building.

As a result more and more modern buildings are being outfitted with air treatment units which can introduce outside air into the building, provide purification of the air, or a combination of both.

In the case of air treatment units which introduce outside air into the building, certain difficulties may arise with relation to the exterior inlet and outlet ports of the air treatment unit. These difficulties arise from the fact that to allow entry of air into the air treatment unit it is necessary to create a hole in the insulation of the building. The insulation of the building thus becomes less efficient.

Unfortunately, there is so far no way of allowing outside air to enter the air treatment unit without allowing a channel to the outside. In fact, most air treatment units require two separate channels to the outside, one through which exhausted air from the inside is released outside, and one through which fresh air from the outside is drawn into the air treatment unit. As a result, it becomes necessary to have two holes in the insulation of the building, thereby making the insulation even weaker.

Furthermore, installation may also become more complex, especially in the case where holes need to be made in a building that has walls constructed from a very hard substance (e.g. bricks or concrete). If a building is made from a very hard substance then the time taken to create a hole might be substantial, and would further require specialised equipment. Thus, installation would be simplified if only a single hole needed to be made in the wall rather than two.

It would therefore be beneficial to have an integrated exterior inlet/exhaust port which would only take up as much space as a typical duct, and which would allow the exhausting of air from the inside of the building, and at the same time allow fresh air to be drawn into the building from the outside.

A problem with this type of duct would be that most air treatment units are designed to use two separate ducts, it would therefore be difficult to fit an integrated exterior inlet/exhaust port to a typical air treatment unit.

Furthermore, due to the close proximity of the inlet duct and the exhaust duct which is necessary for an integrated exterior inlet/exhaust port, there is the danger of short-circuiting the air flow. In this case the inlet duct would draw in the air exhausted from the exhaust duct, instead of drawing fresh air from the outside.

It is therefore apparent that an integrated exterior inlet/exhaust port which can easily be connected to existing air treatment units, and which prevents short-circuiting of the inlet and the exhaust air flow is desirable.

STATEMENT OF THE INVENTION

In accordance with one aspect the invention provides a dual opening air communication unit comprising:

a shell component;

a first channel component formed in said shell component for communicating a first air stream between a first air channel and an outside; and an second channel component formed in said shell component for communicating a second air stream between a second air channel and said outside;

said first channel component and said second channel component being formed such that said first air stream and said second air stream are transverse to each other.

In accordance with a more particular aspect said first air stream may be an exhaust air stream, and wherein said second air stream may be a fresh air stream.

In accordance with a more particular aspect the invention may further comprise a component for varying the speed of the air in dual opening air communication unit, adapted such that said exhaust air stream may have a higher speed than said fresh air stream.

In accordance with a further aspect the invention provides a ventilation duct comprising:

a first channel component;

a second channel component; and adapter component for connecting said first channel component and said second channel component to separate ducts;

said first channel component and second channel component being disposed such that a flow of a gas passing through one channel will not be able to pass to the other channel.

In accordance with a more particular aspect said first channel component and second channel component may share a common wall.

DETAILED DESCRIPTION

Figure 1:
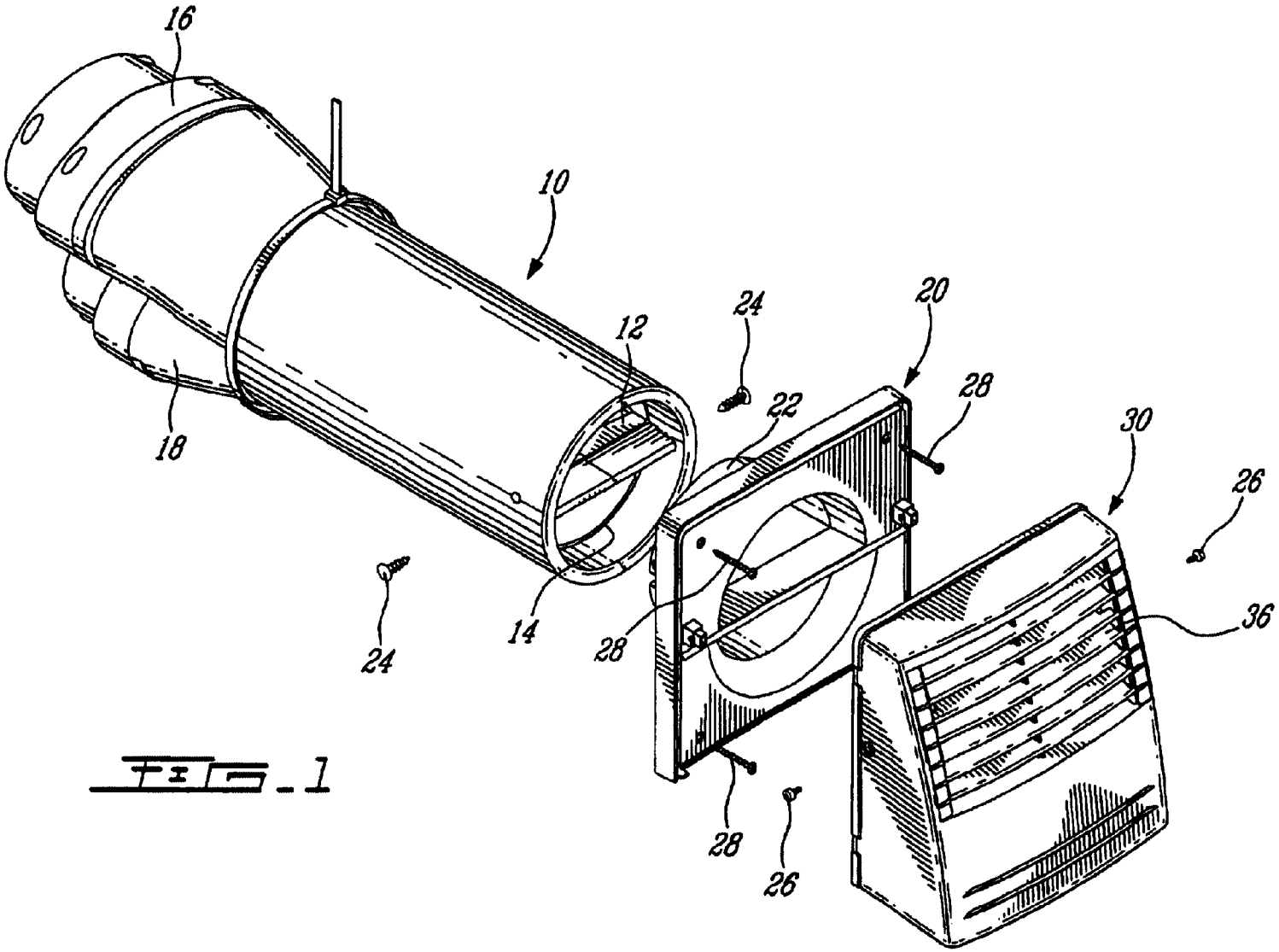
FIG. 1 shows an exploded perspective view of an integrated exterior inlet/exhaust port according to the present invention.
Figure 2:
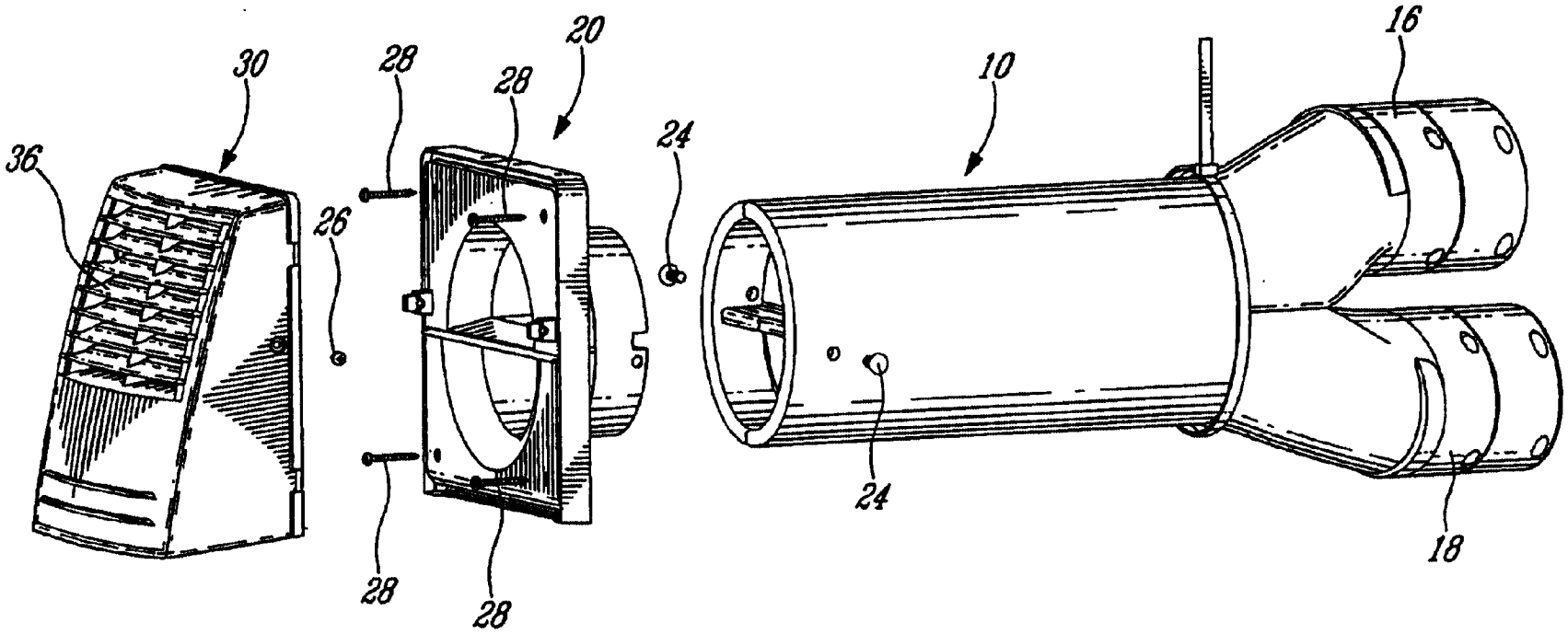
FIG. 2 shows an exploded side elevation view of the integrated exterior inlet/exhaust port shown in FIG. 1.

FIGS. 1 and 2 show exploded views of an integrated exterior inlet/exhaust port according to the present invention. As can be seen in the FIGS. 1 and 2 the invention in this embodiment comprises three main components. These components are adapter duct 10, backplate 20, and port 30.

Additionally, the integrated exterior inlet/exhaust port may be provided with insulation so as to prevent the creation of cold spots in the interior of the building.

It can be noted that while the embodiment shown in FIGS. 1 and 2, comprises separate adapter duct 10, backplate 20, and port 30 another embodiment in which one or more of the elements are formed integral can easily be imagined.

The adapter duct 10 is made up of two separate air passages 12 and 14 which at one end separate into an y-shape which forms two distinct ducts 16 and 18. At the other end the two air passages combine and form a single duct.

The adapter duct 10 is designed to be connected to the port 30 via the backplate 20. The backplate 20 has a continuous snap groove 22 which can be matingly connected to the single duct end of the adapter duct 10. The connection of the continuous snap groove 22 and the adapter duct 10, is designed so as to be air and water tight. Additional fastening means 24 (e.g. screws) may be employed to ensure that the adapter duct remains fastened to the backplate 20. The backplate 20 also has fastening means 26 for fastening the backplate 20 to the port 30, and fastening means 28 for fastening the inlet/outlet port to the wall of the building.

Figure 3:
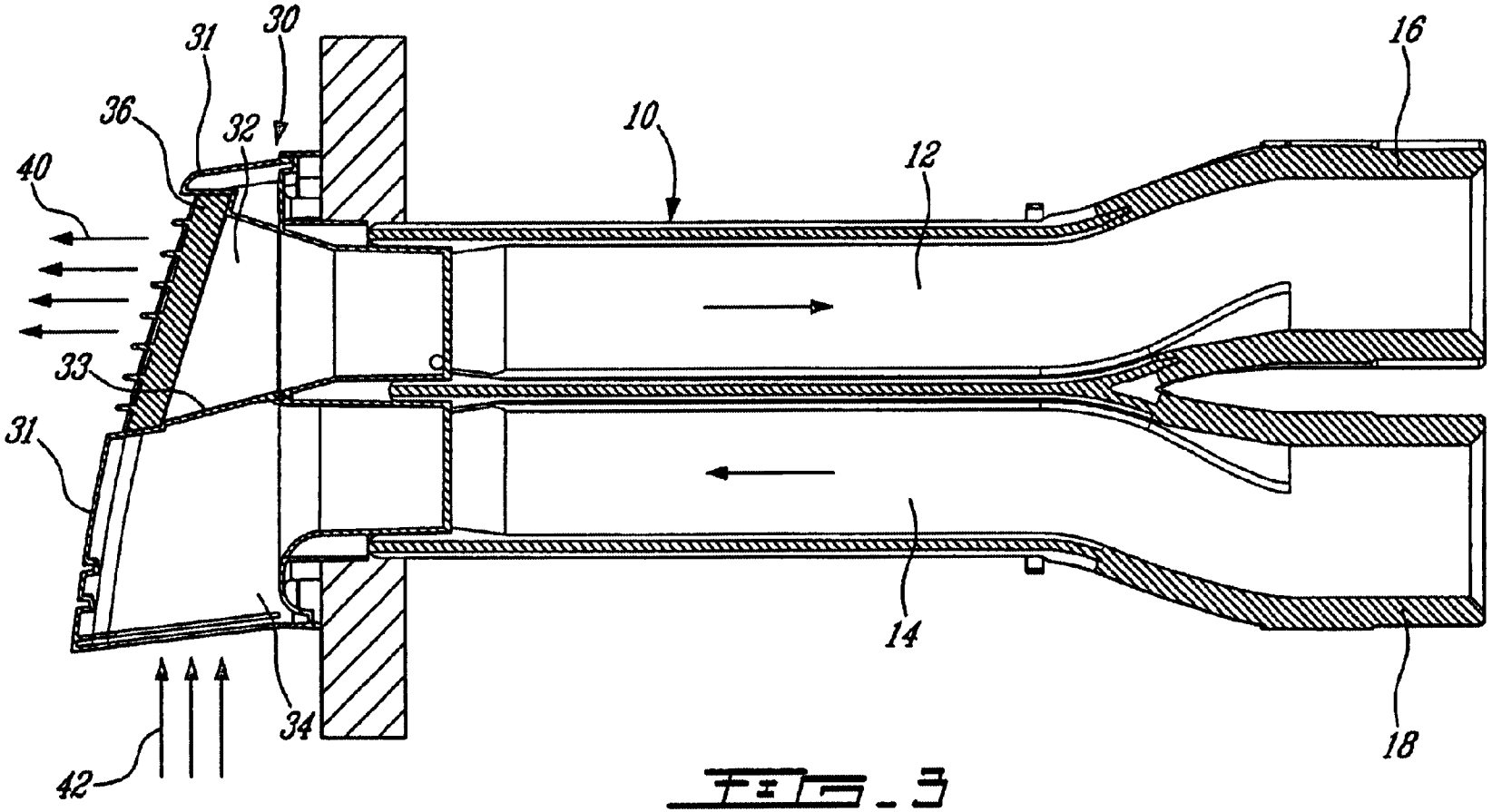
FIG. 3 shows a cross section of the integrated exterior inlet/exhaust port shows in FIG. 1, which has been installed in a wall of a building.

Port 30, as can be seen in FIG. 3, comprises a shell component 31 which is split into a first channel component 32 and a second channel component 34, which connect to the air passages 12 and 14 of the adapter duct 10 respectively. The first channel component 32 is covered by a grill 36 through which air may pass. Additionally, the first channel component 32 may have a downwardly angled floor 33 such that any accumulation of water or other liquids will automatically be drained from the chamber. The first channel component 32 may also be provided with some drain holes in case of an abnormal water condition.

FIG. 3 also shows the integrated exterior inlet/exhaust port in function. In the embodiment shown in FIG. 3, an air treatment unit (not shown) is connected to the adapter duct 10 by connecting an exhaust duct and an inlet duct to the ducts 16 and 18 respectively. Thus exhaust air is exhausted through passage 12 and first channel component 32, and fresh air is drawn in through passage 14 and second channel component 34.

A first arrow set 40 shows the flow of exhaust air exiting the integrated exterior inlet/exhaust port, and a second arrow set 42 shows the flow of air entering the integrated exterior inlet/exhaust port. As can be seen from the arrow sets 40 and 42 the entering and exiting air flows are physically separate, and are also transverse to each other. That is there is an angle between the directions of the exiting air and the entering air. The physical separation and the different directions both work to reduce the risk of short circuiting the air flows.

Another benefit of the air flow arrangement shown in FIG. 3 is that the exhaust air flow will act as a shield for the inlet air flow, in that the exhaust air flow will blow away any particles (e.g. snow or dirt) which fall near the integrated exterior inlet/exhaust port. Thus, accumulation of these particles which could cause a blockage of the inlet port, is prevented.

In another embodiment, the air passage 12 may be reduced in circumference compared to air passage 14, such that the speed of the air travelling though air passage 12 would be increased compared to the air travelling trough air passage 14. This would be beneficial since increasing the speed of the exhaust air flow in relation to the speed of the intake air flow would also reduce the risk of the air flows being short circuited, and the intake air flow being contaminated by the exhaust air flow.

Figure 4:
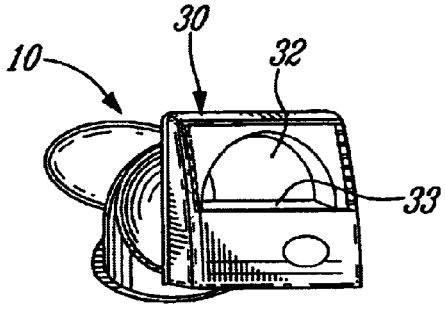
FIG. 4 shows a front view of the integrated exterior inlet/exhaust port shown in FIG. 1, with a grill removed.

FIG. 4 shows a front view of the integrated exterior inlet/exhaust port. In this view the grill 36 has been removed so that the first channel component 32 can be clearly seen. As can be seen the upper section 32 may have a funnel like shape, with the first channel component 32 expanding outwards.

Figure 5:
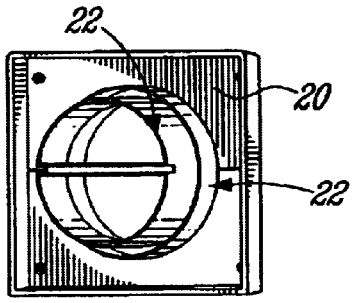
FIG. 5 shows a back elevation view of a back plate as shown in FIG. 1.
Figure 6:
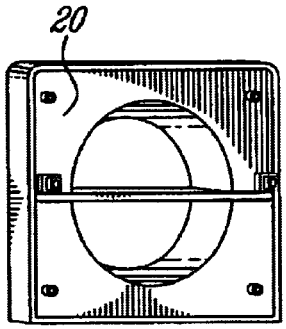
FIG. 6 shows a front elevation view of the back plate shown in FIG. 5.

FIGS. 5 and 6 show the front and back of the backplate 20. As can be seen the snap groove 22 has been divided in two such that the air passages 12 and 14 (see FIG. 2) do not cross.

Figure 7:
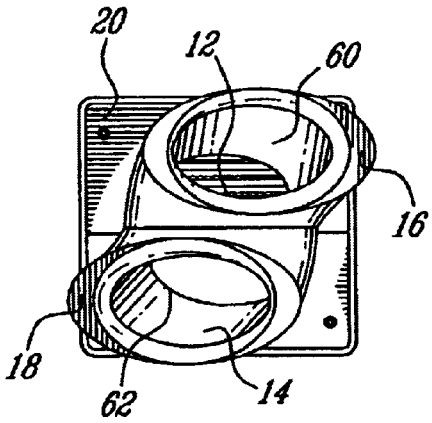
FIG. 7 shows a rear elevation view of an integrated exterior inlet/exhaust port shown in FIG. 1.

FIG. 7 shows a rear view of the integrated exterior inlet/exhaust port. The two distinct ducts 16 and 18, and the air passages 12 and 14 can be clearly seen. In the embodiment shown in FIG. 7, the two distinct ducts 16 and 18 may be given a lateral offset with respect to each other, such that the two distinct ducts 16 and 18 can more easily be fitted between the joists of the building, thereby providing a compact installation.

Furthermore, the distance between the distinct ducts 16 and 18 is preferably large enough that insulation may be inserted around the distinct ducts 16 and 18 and the ducts which are attached to them.

FIG. 7 also shows the transition sections 60 and 62 of the distinct ducts 16 and 18, where the two distinct ducts 16 and 18 join together to from a single tube. As can be seen from the diagram the transition sections 60 and 62 may be smoothed so as to reduce friction between the air and the walls of the ducts 16 and 18. This allows for a reduction of turbulence within the ducts.

Figure 8:
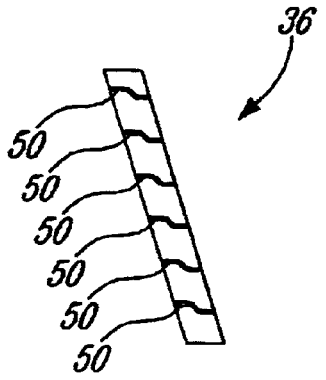
FIG. 8 shows a side view of a grill for the integrated exterior inlet/exhaust port shown in FIG. 1.
Figure 9:
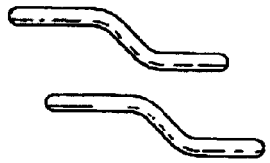
FIG. 9 shows a side view of a pair of baffles to be used with a grill according to one embodiment of the invention.

FIG. 8 shows a side view of the grill 36 shown in FIG. 1. As can be seen the grill 36 comprises a series of baffles 50. The baffles 50 may have an S-shape as shown in FIG. 9 or have a chevron shape as shown in FIG. 8, such that rain, snow, etc. which falls on the grill will automatically drain, and not be able to enter the port and cause a blockage.

Figure 10:
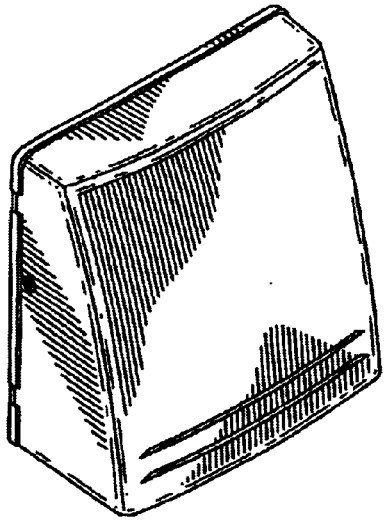
FIG. 10 shows a perspective view of an air inlet or exhaust port according to previous systems.

Turning now to FIG. 10, we can see an example of an exterior inlet or outlet port as used with prior air treatment units.

It should be noted that while the above embodiments of the invention have been described with relation to an integrated exterior inlet/exhaust port, the invention may easily be used as an integrated exterior inlet/inlet port, or an integrated exterior exhaust/exhaust port.

What is claimed is:

1. A dual opening air communication unit comprising:

a shell component;

a first channel component formed in said shell component for communicating a first air stream between a first air channel and an outside; and an second channel component formed in said shell component for communicating a second air stream between a second air channel and said outside;

said first channel component and said second channel component being formed such that said first air stream and said second air stream are transverse to each other;

said first air stream being an exhaust air stream;

said second air stream being a fresh air stream;

said first channel component and said second channel component sharing a common wall having a first channel side associated with said first channel component;

said first channel side defining a drainage floor element downwardly angled toward said outside.

* * * * *